US008441198B2

(12) United States Patent
Lee

(10) Patent No.: US 8,441,198 B2
(45) Date of Patent: May 14, 2013

(54) METHOD AND DEVICE FOR DRIVING LIGHT-EMITTING DIODE

(75) Inventor: Chien-Kuo Lee, Pingzhen (TW)

(73) Assignee: Alder Optomechanical Corp., Pingzhen (TW)

( * ) Notice: Subject to any disclaimer, the term of this patent is extended or adjusted under 35 U.S.C. 154(b) by 264 days.

(21) Appl. No.: 13/097,359

(22) Filed: Apr. 29, 2011

(65) Prior Publication Data

US 2012/0274226 A1 Nov. 1, 2012

(51) Int. Cl.
*H05B 37/02* (2006.01)

(52) U.S. Cl.
USPC ..... 315/210; 315/250; 315/291; 315/302

(58) Field of Classification Search ..... 315/210, 315/217, 250, 209 R, 291, 294–295, 297, 315/302, 307
See application file for complete search history.

(56) References Cited

U.S. PATENT DOCUMENTS 6,577,072 B2 * 6/2003 Saito et al. ..... 315/185 R
7,952,295 B2 * 5/2011 Otake et al. ..... 315/224
8,063,575 B2 * 11/2011 Tobler et al. ..... 315/291

* cited by examiner

*Primary Examiner* — James H Cho
(74) *Attorney, Agent, or Firm* — Jackson IPG PLLC

(57) ABSTRACT

A device and a method for driving a light-emitting diode include using multiple current guiding control circuits to drive multiple LED modules. Each of the current guiding control circuits includes at least two transistors connected in parallel to constitute at least two switch circuits. Each of the current guiding control circuits permits or prevents electric current to flow to an immediate downstream one of the LED modules in response to a predetermined voltage level of the positive part of a voltage source. The respective the current guiding control circuits are responsive to different voltage levels. As a result, a maximum number of LED modules are driven to emit light at a given voltage level, thereby achieving the purposes of efficiently utilizing electric power and reducing power loss.

8 Claims, 8 Drawing Sheets

METHOD AND DEVICE FOR DRIVING LIGHT-EMITTING DIODE

BACKGROUND OF THE INVENTION

1. Field of the Invention

The present invention relates to a driving method, and more particularly, to a method and device for driving a light-emitting diode (LED) with an improved power factor and power utilization efficiency and a reduced electromagnetic interference.

2. Description of the Prior Art

As natural energy resources are being used up, some new substitute energy resources are proposed but cannot immediately answer and fulfill all human needs and requirements. Therefore, saving natural resources becomes a very important issue. Accordingly, many electronic devices or equipments are improved in the hope of decreasing power consumption. For example, assuming that a conventional tungsten lamp consumes 100 units of electric power, only 5 units of electric power is transformed into light and the rest of the electric power is transformed into the heat. Thus, the transforming efficiency of the conventional tungsten lamp is much less than satisfactory. Additionally, a heat sink or a cooler system may be required to dissipate the heat generated from the conventional tungsten lamp, which will consume additional electric power. The conventional lamp equipments have long suffered from the drawback of low power utilization efficiency. As the technology development and innovation in semiconductor industry have quickly advanced in the recent years, light-emitting diodes (LEDs) continue to gain popularity and are increasingly used in illumination application, taking advantage of their long service life and low power consumption.

As mentioned above, LEDs are advantageous in long service life, low power consumption and low waste heat generation. All of these advantages promote the development of LED lighting equipments. An LED is normally driven by a DC power source. As such, when the LED is connected to an AC power source, such as a mains electricity supply, it has to be provided with an LED driver circuit that converts the incoming AC power into a pulsed DC power, so that the LED can emit light upon receipt of the DC power.

As shown in FIG. 4(A), a conventional LED driver circuit 100 is connected to at least one LED 101 and adapted to receive an AC power VAC. The LED driver circuit 100 mainly comprises abridge rectifier 110 and a capacitor C. The bridge rectifier 110 is used to rectify the AC power VAC into a pulsed DC power, and then the capacitor C stabilizes the voltage of the pulsed DC power for driving the LED 101 to emit light. As shown in FIG. 4(B), a constant current circuit is further provided to maintain the current at a constant level, thereby stabilizing the brightness and chromaticity of the light emission from the LED. An inductive reactance element, such as a capacitor or an inductor, if present in the circuit, will make the voltage and current out of phase by a phase difference (θ), as shown in FIG. 4(C). Given the equation that PF(Power Factor)=V(Voltage)×I(Current)×cos θ, since the voltage and current is out of phase in this case, the presence of the phase difference (θ) causes a decrease in power factor which in turn results in an increase in power loss.

R.O.C. Patent No. 1220047, entitled "LED Driver Circuit," discloses an LED driver circuit as shown in FIG. 5, which includes a power source 51, multiple current guiding control circuits 52 composed of one or more common-ground current control units 521, and a voltage detection circuit 53 for detecting the voltage level of the supplied power. The power source 51 is connected in series to one or more LED sets 54, each being composed of one or more LEDs. The current control units 521 of the current guiding control circuits 52 are sequentially connected to the N-electrodes (negative electrodes) of the respective LED sets 54. The voltage level of the positive part of the supplied power is detected by the voltage detection circuit 53. Then, one of the current guiding control circuits 52 is selectively placed in a conductive state according to the voltage level, whereby a suitable amount of the LED sets 54 are driven to emit light. Such a circuit design allows the voltage of the positive part of the supplied power to directly drive the LED sets, so that a maximum number of LED sets are driven to emit light according to the voltage level without coupling to a filtering capacitor, thereby achieving the purposes of efficiently utilizing electric power, increasing power factor and reducing power loss.

However, the driver circuit described above has the following drawbacks:

1. A voltage detection circuit is required for detecting the voltage level of the positive part of the supplied power, leading to a complicated circuit construction.

2. A selected one of current guiding control circuits is placed in a conductive state under the circumstance that the voltage detection circuit detects the incoming voltage level (the remaining current guiding control circuits are kept in an electrically disconnected state), thereby allowing a particular amount of LED sets to emit light. In the case of malfunction of the voltage detection circuit, none of the LED sets can be driven to emit light.

SUMMARY OF THE INVENTION

Accordingly, an object of the invention is to provide a driving method, and more particularly, to a method and device for driving a light-emitting diode (LED) directly by AC mains power without switching the frequency, thereby achieving the purposes of improving power factor and reducing power loss and electromagnetic interference.

In order to achieve this object, the inventive driving method comprises using a plurality of current guiding control circuits to drive a plurality of LED modules, wherein each of the current guiding control circuits includes at least two transistors connected in parallel to constitute at least two switch circuits. Each of the respective current guiding control circuits is adapted to permit or prevent electric current to flow to an immediate downstream one of the LED modules in response to a predetermined voltage level of the positive part of a voltage source. The respective current guiding control circuits are responsive to different voltage levels. As a result, a maximum number of LED modules are driven to emit light at a given voltage level, thereby achieving the purposes of efficiently utilizing electric power and reducing power loss.

BRIEF DESCRIPTION OF THE DRAWINGS

The above and other objects, features and effects of the invention will become apparent with reference to the following description of the preferred embodiments taken in conjunction with the accompanying drawings, in which.

DETAILED DESCRIPTION OF THE PREFERRED EMBODIMENTS

Figure 1:
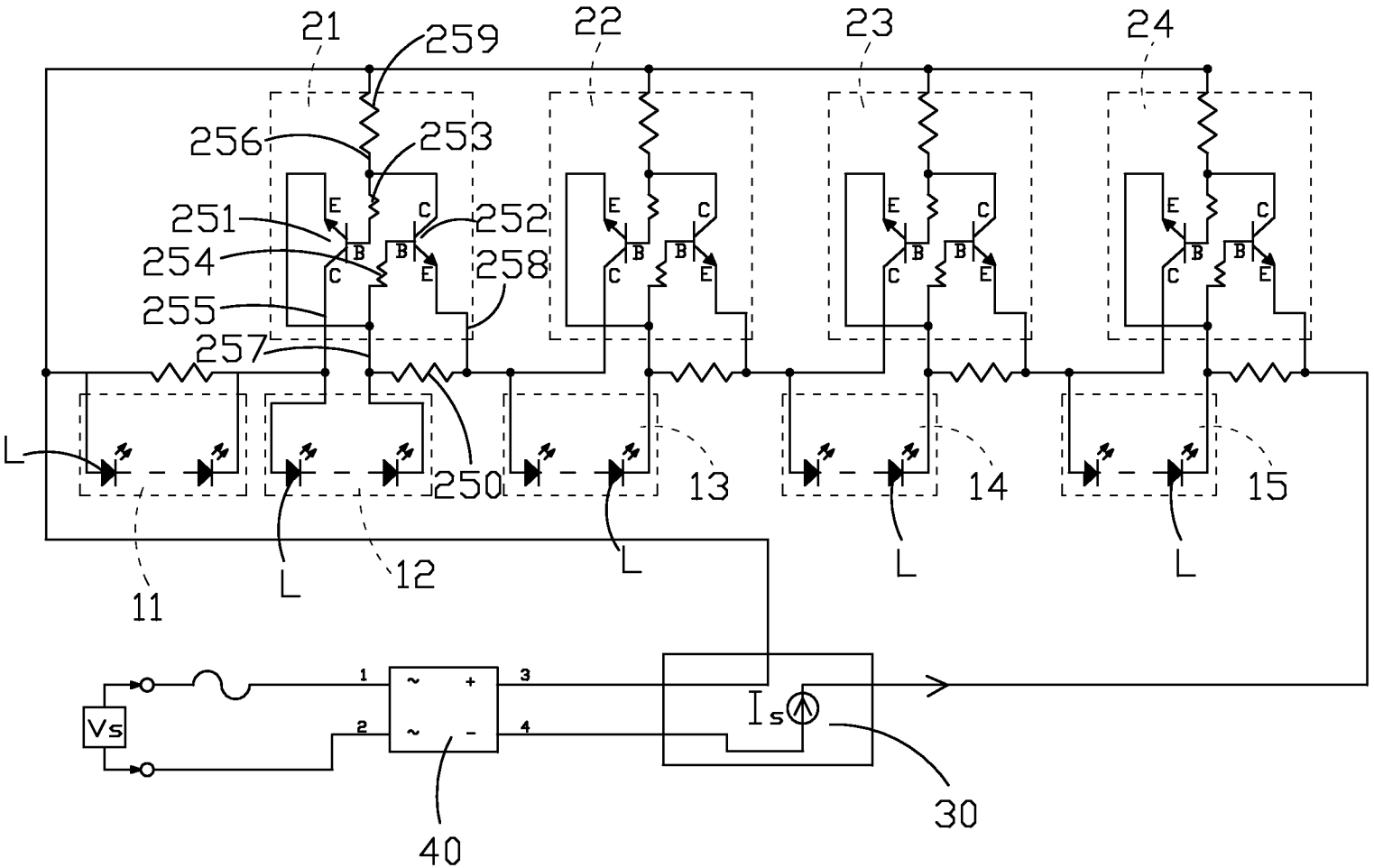
FIG. 1 is a schematic diagram illustrating a driver device according to the invention.

The present invention provides a method for driving a light-emitting diode. The method comprises using a plurality of current guiding control circuits to drive a plurality of LED modules, wherein each of current guiding control circuits includes at least two transistors connected to constitute at least two switch circuits, and wherein the respective current guiding control circuits differ from one another by their responses to different current levels of a voltage source, so that the respective LED modules under their control are selectively driven to emit light at different voltage levels. In actual practice, the invention further provides a driver device as illustrated in FIG. 1, which comprises the following constituting elements:

(1) Voltage Source (vs)

Figure 3A:
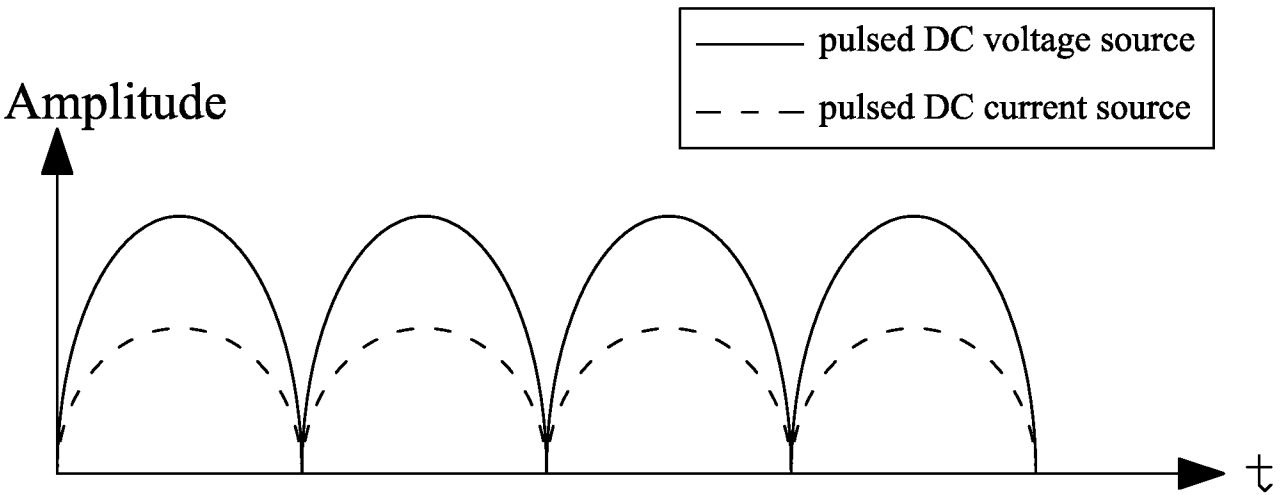
FIG. 3(A) is a diagram showing the phases of a pulsed DC voltage source and the pulsed DC current source according to the invention.

The voltage source is provided with a rectifying circuit 40 (which may by way of example be a bridge rectifier), so that an alternating current (AC) power received from the voltage source is converted into a pulsed direct current (DC) voltage source, as shown in FIG. 3(A).

(2) Current Guiding Control Circuit

At least two LED modules are preferably included in the inventive device. According to the embodiment illustrated in FIG. 1, there are five LED modules 11, 12, 13, 14, 15 included in the device, each comprising single or multiple LEDs L connected in series, or in parallel, or in a combination of both. Preferably, the amount of the LEDs mounted in the respective LED modules are gradually increased and then decreased from the LED module 11 to the LED module 15.

At least one current guiding control circuit is coupled between two adjacent LED modules. According to the embodiment illustrated in FIG. 1, there are four current guiding control circuits 21, 22, 23, 24 included in the device, each being provided with first and second transistors 251, 252, first to fourth resistors 253, 254, 259, 250, first and second input terminals 255, 256, and first and second output terminals 257, 258.

The first and second transistors 251, 252 are each provided with a first terminal, a second terminal and a control terminal. According to this embodiment, the first and second transistors 251, 252 are NPN-type bipolar junction transistors (BJT), in which the first terminal, the second terminal and the control terminal pertain to an emitter E, a collector C and a base B, respectively.

Figure 2:
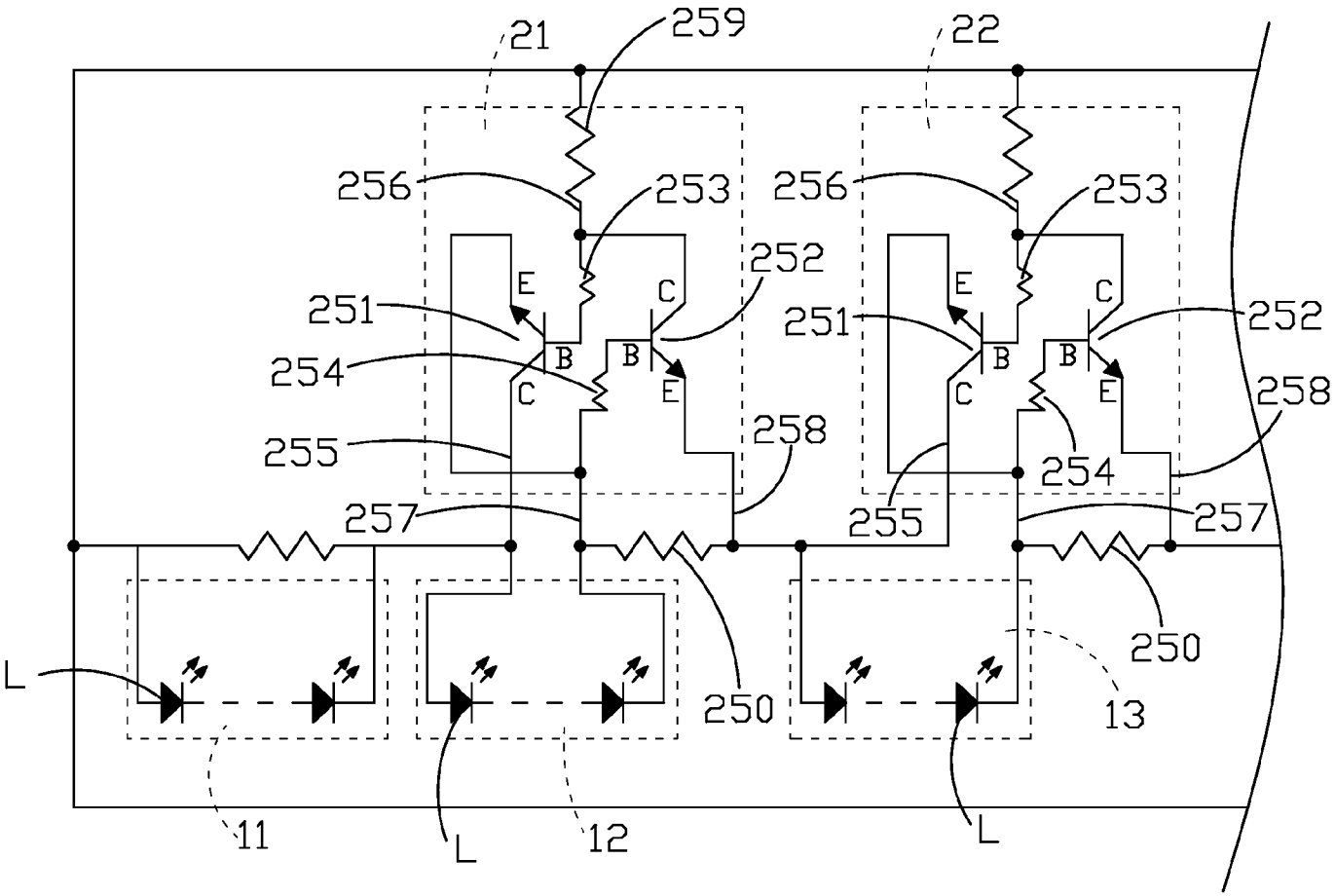
FIG. 2 is a partially enlarged schematic view of the driver device according to the invention.

Now referring to FIG. 2, the first input terminal 255 is connected in parallel to a positive electrode of one of the LED modules 12, 13, 14, 15 and connected in series to a negative electrode of another one of the LED modules 11, 12, 13, 14 which is upstream of the one LED module. The second input terminal 256 is connected to the voltage source Vs for receiving the rectified power. The first input terminal 255 is connected to the emitter E at the first terminal of the first transistor 251. The base Bat the control terminal of the first transistor 251 is connected to an end of the first resistor 253, while the other end of the first resistor 253 and the collector C at the first terminal of the second transistor 252 are connected via a common line to the second output terminal 256 where a third resistor 259 is mounted. The base B at the control terminal of the second transistor 252 is connected to an end of the second resistor 254, while the other end of the second resistor 254 and the emitter E at the second terminal of the first transistor 251 are connected via a common line to the first output terminal 257 which is in turn connected to the negative electrode of the LED module under its control. The emitter E at the second terminal of the second transistor 252 is coupled to the second output terminal 258 which is in turn connected to a positive electrode of another one of the LED modules 13, 14, 15 which is downstream of the one LED module. The fourth resistor 250 is coupled between the base B at the control terminal and the emitter E at the second terminal of the second transistor 252.

(3) Current Source Circuit

A current source circuit 30 is coupled between the rectifying circuit 40 and the LED modules 11-15 and adapted to convert the pulsed DC voltage source into a pulsed DC current source in phase therewith. The current source circuit 30 provides a loop current to the respective LED modules 11-15 to achieve a satisfactory power factor.

Figure 3B:
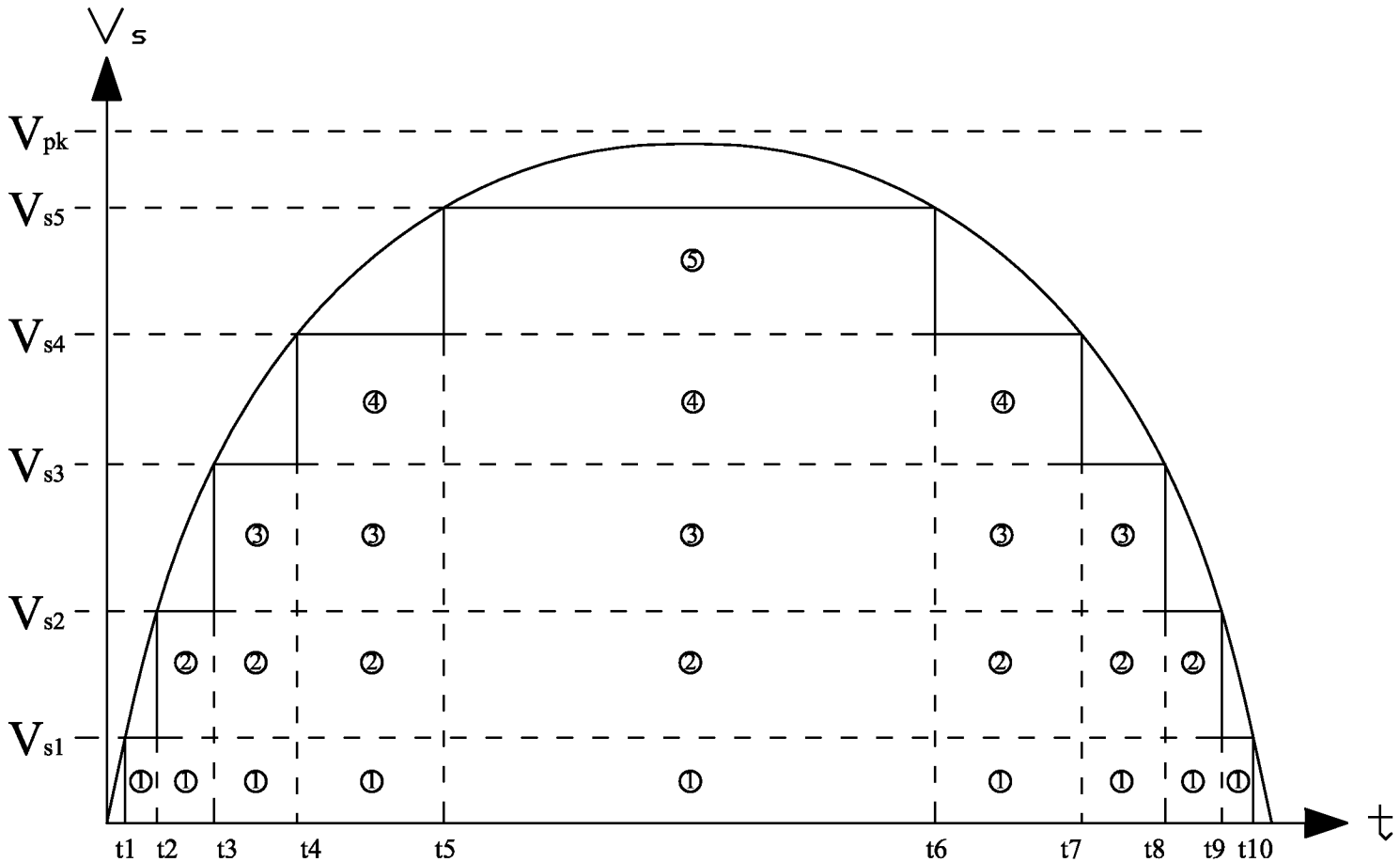
FIG. 3(B) is a diagram showing the ON/OFF states of the respective LED modules within a half wave period of the supplied AC power.
Figure 4A:
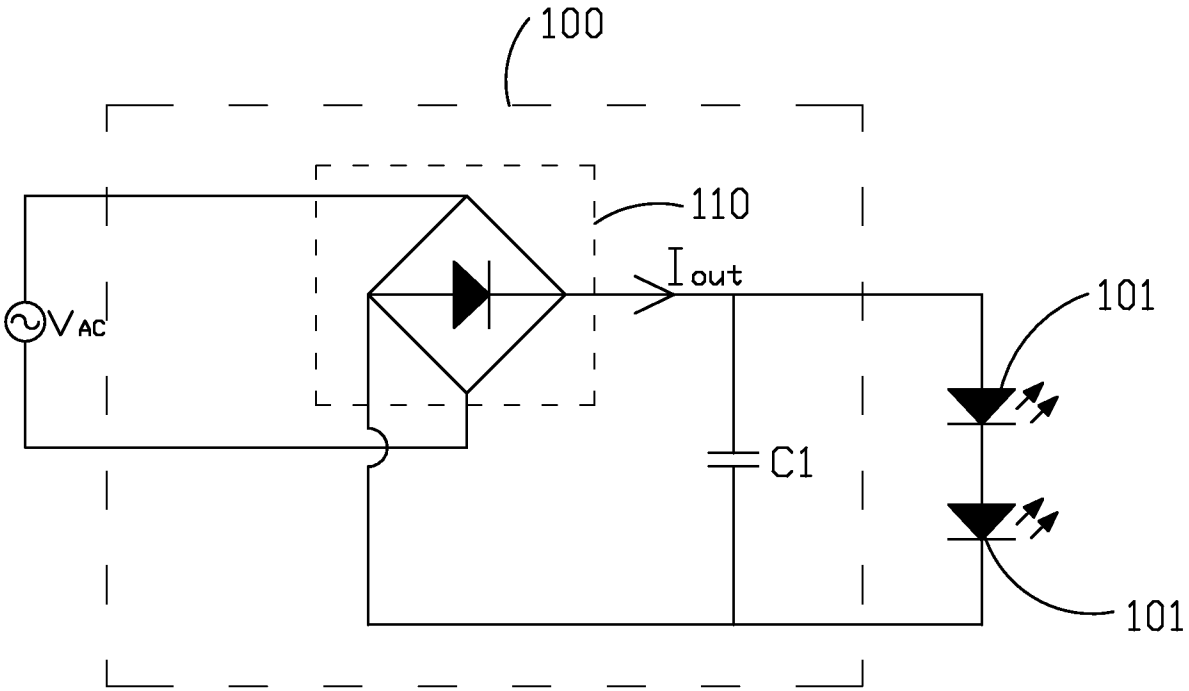
FIG.4A PRIOR ART
FIG. 4(A) is a schematic diagram illustrating a conventional driver device.
Figure 4B:
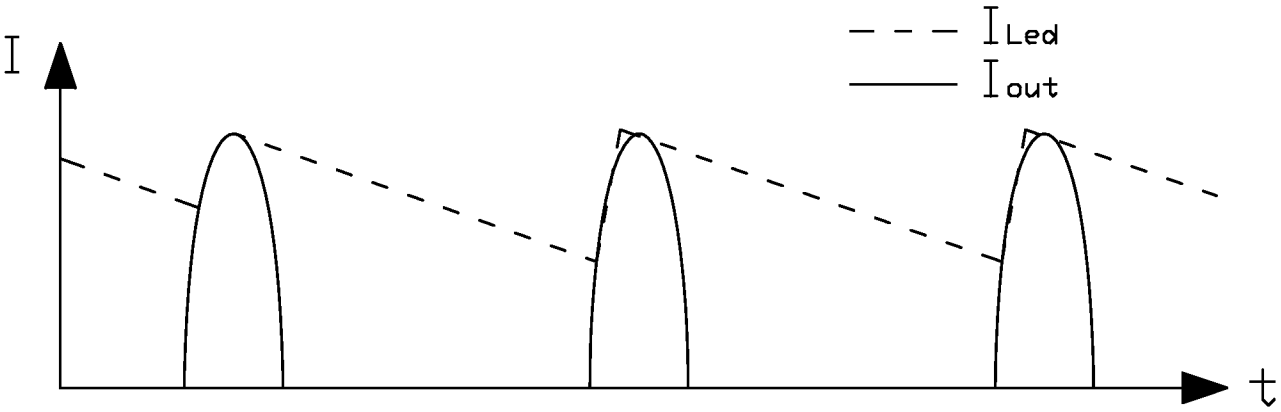
FIG.4B PRIOR ART
FIG. 4(B) is a diagram showing the current flow by using a conventional driver device provided with a filter circuit.
Figure 4C:
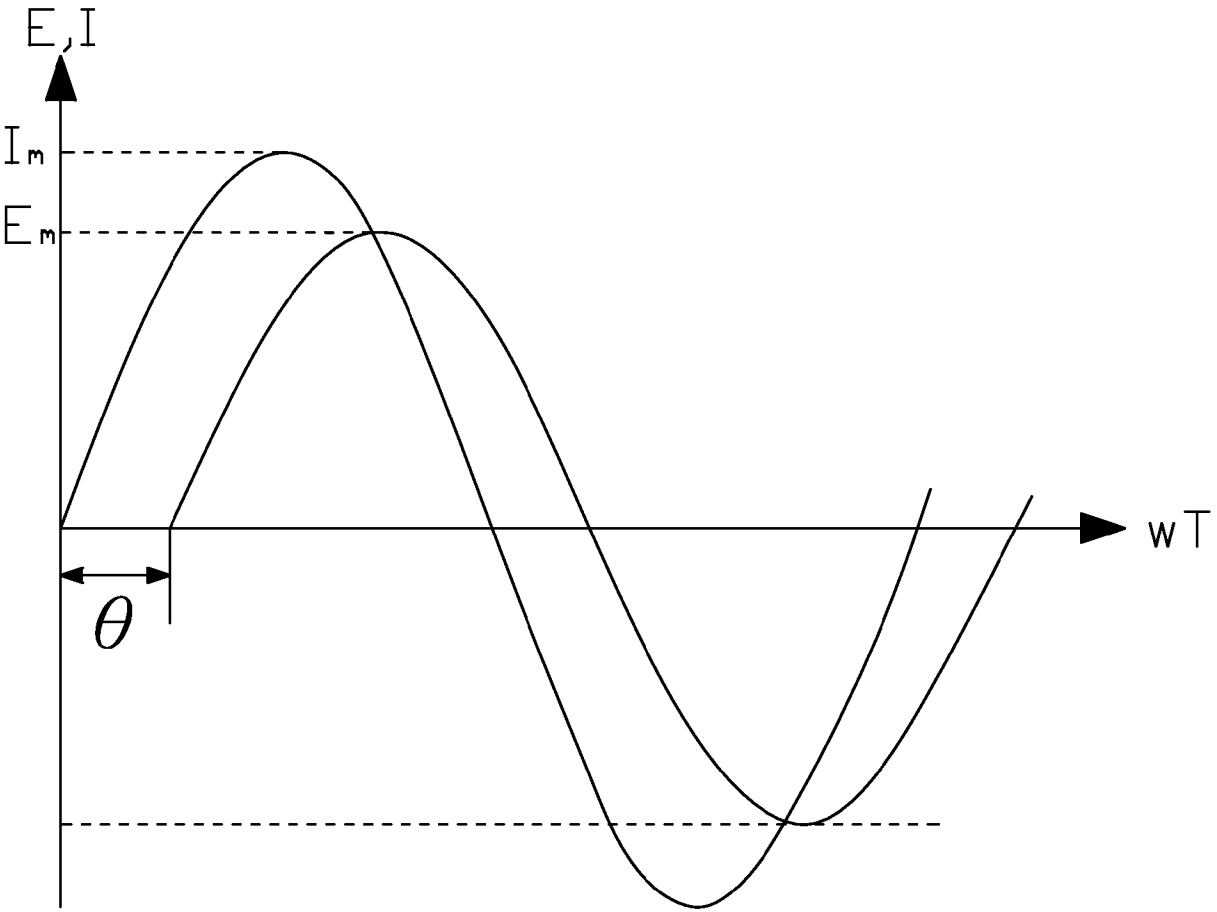
FIG.4C PRIOR ART
FIG. 4(C) is a diagram showing the current leads the voltage.
Figure 5:
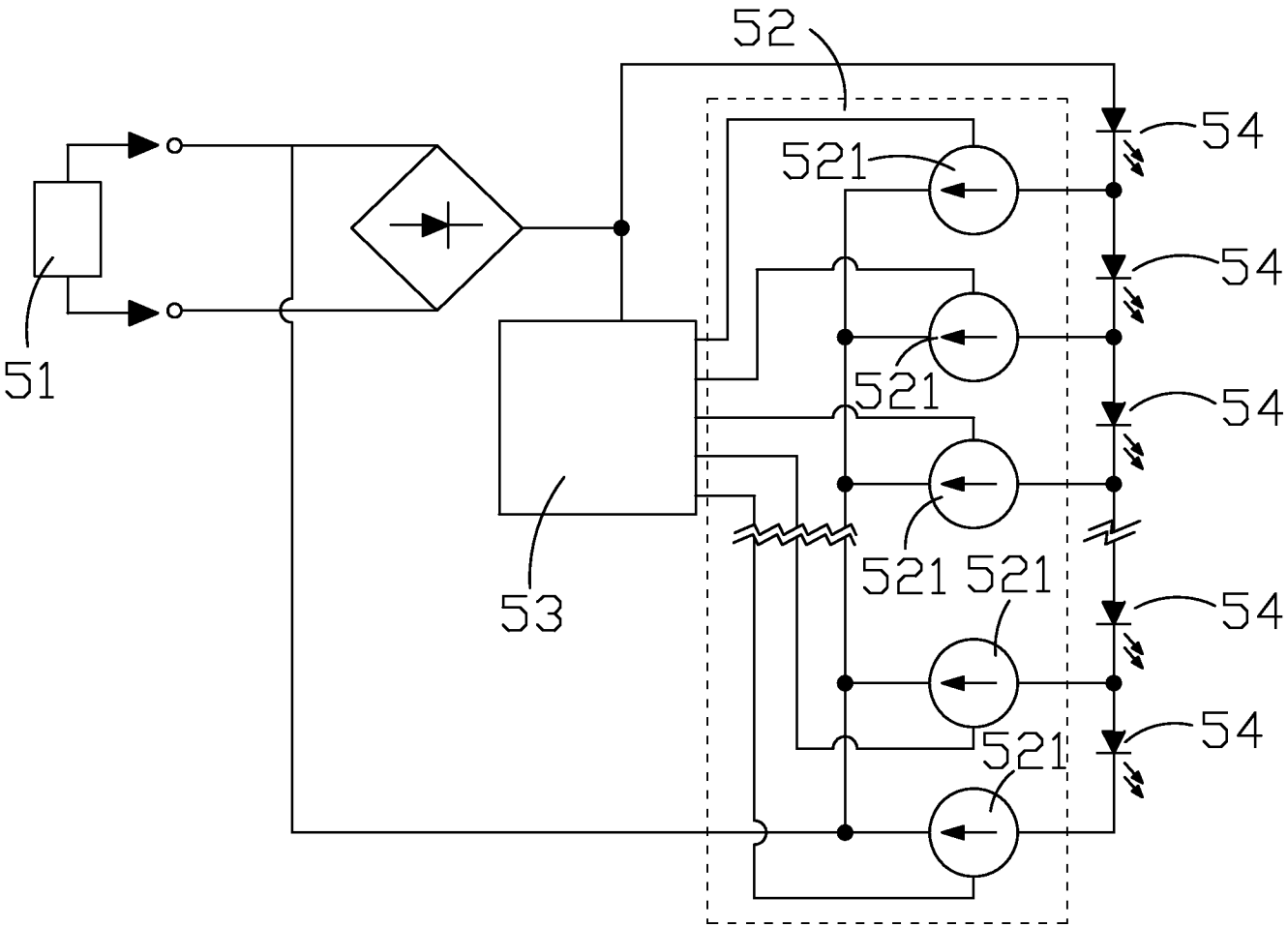
FIG.5 PRIOR ART
FIG. 5 is a schematic diagram showing the driver circuit disclosed in R.O.C. Patent No. 1220047.

FIG. 3(B) is a diagram showing the ON/OFF states of the respective LED modules within a half wave period of the supplied AC power. The first LED module 11 receives sufficient electric current and starts to emit light when the voltage of the power source reaches a level of Vs1. Before the voltage of the power source is further increased to a level of Vs2 to allow the second LED module to receive power, the second transistor 252 in the first current guiding control circuit is operated in its cut-off region and switched OFF because the voltage applied to the fourth resistor 250 coupled between the base B and the emitter E of the transistor 252 is insufficient to make it conductive. As a result, the second output terminal 258 is placed in an electrically disconnected state. On the other hand, the first transistor 251 receives a voltage from the second input terminal 256 via the third resistor 259 and, therefore, is operated in its saturated region and switched ON, so that electric current is allowed to flow through the emitter E and collector C of the first transistor 251 to the immediate downstream LED module and the immediate downstream current guiding control circuit.

Similarly, the second transistor in the immediate downstream current guiding control circuit will not be biased conductive since the incoming voltage is lower than Vs2. As a consequence, the first transistor is in the ON state, allowing electric current to flow to the next downstream LED module and the next downstream current guiding control circuit.

If the voltage of the power source rises to a level above Vs2 at which electric current is allowed to flow to the second LED module, the second transistor 252 is forward biased and operated in its saturated region as the applied voltage is sufficient to bias the fourth resistor 250 in the first current guiding control circuit 21. This causes a closed circuit between the emitter E and the collector C of the second transistor 252. At this moment, the first transistor 251 is not biased and is therefore operated in its cut-off region and switched OFF, placing the first input terminal 255 in an electrically disconnected state. The electric current is thus allowed to flow through a conductive path from the positive electrode to the negative electrode of the second LED module 12, thereby turning on the first and second LED modules 11, 12 and causing illumination. The rest of the current guiding control circuits allow electric current to the downstream LED module (s) and the next downstream current guiding control circuit(s) via the first transistor(s), due to insufficient level of the applied voltage. Within the time interval from t2 to t3 as shown in FIG. 3(B), the voltage level of the power source (from Vs2 to Vs3) is higher than that permitting electric current to flow to the second LED module 12, and only the first and second LED modules 11, 12 are turned on to emit light (as indicated by zones 1 and 2). The rest may be deduced by analogy.

In order to manufacture the inventive device, the respective current guiding control circuits are mounted on a circuit board and then electrically connected to the respective LED modules. As an alternative, the respective current guiding control circuits and the respective LED modules are together packaged in an integrated circuit package.

A preferred embodiment employs at least two transistors to constitute at least two switch circuits and to serve as a current guiding control circuit for controlling an LED module. A preferred embodiment involves providing a rectifying circuit to receive power from a voltage source and to provide a pulsed direct current (DC) voltage source, and providing a current source circuit to provide a loop current corresponding to different voltage levels of a positive part of the voltage source, and allowing the respective LED modules emit light upon being driven by the respective current guiding control circuits. Each of the current guiding control circuits is capable of selectively permitting electric current to flow therethrough in response to a predetermined voltage level applied thereto. The respective current guiding control circuits are responsive to different predetermined current levels. The current guiding control circuits are each provided with a fourth resistor for setting a voltage threshold level that controls electric current to flow to the LED module under its control. As such, the respective LED modules are driven to emit light within a cycle of AC mains power, in the case where the voltage level applied to the current guiding control circuits corresponding thereto reaches the predetermined current threshold levels. By virtue of the preferred embodiments disclosed herein, a maximum number of LED modules are driven to emit light at a given voltage level, thereby achieving the purposes of efficiently utilizing electric power and reducing power loss.

In conclusion, the method and device for driving an LED as disclosed herein can surely achieve the intended objects and effects of the invention by virtue of the structural arrangements described above. While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit of the invention and the scope thereof as defined in the appended claims.

What is claimed is:

1. A method for driving a light-emitting diode comprising the steps of:

providing a rectifying circuit to receive power from a voltage source and provide a pulsed direct current (DC) voltage source;

providing a current source circuit to provide a loop current corresponding to different current levels of a positive part of the voltage source; and placing a plurality of LED modules under control of a plurality of current guiding control circuits in such a manner that the respective LED modules emit light upon being driven by the respective current guiding control circuits, wherein each of the current guiding control circuits includes at least two transistors to constitute at least two switch circuits to selectively permit electric current to flow therethrough in response to a predetermined current level applied thereto, with the respective current guiding control circuits being responsive to different predetermined current levels;

whereby the respective LED modules are driven to emit light within a cycle of AC mains power, in the case where the voltage level applied to the current guiding control circuits corresponding thereto reaches the predetermined current levels.

2. The driving method according to claim 1, wherein the current source circuit converts the pulsed DC voltage source into a pulsed DC current source in phase therewith, so as to provide the loop current to the respective LED modules.

3. A device for driving a light-emitting diode, comprising:

a voltage source for providing an AC voltage;

a rectifying circuit for converting the AC voltage from the voltage source into a pulsed direct current (DC) voltage source;

a current source circuit coupled between the rectifying circuit and a plurality of LED modules and adapted to convert the pulsed DC voltage source into a pulsed DC current source in phase therewith, so as to provide a loop current to the respective LED modules;

at least two LED modules, each comprising multiple LEDs connected in series, in parallel, or in a combination of both;

at least two current guiding control circuits coupled between adjacent ones of the LED modules, each being provided with first and second transistors, first to fourth resistors, first and second input terminals, and first and second output terminals, wherein the first input terminal is connected in parallel to a positive electrode of one of the LED modules and connected in series to a negative electrode of another one of the LED modules which is upstream of the one LED module, and wherein the second input terminal is connected to the voltage source via the third resistor, and wherein the first output terminal is connected to a negative electrode of the one LED module and the second output terminal is connected to a positive electrode of another one of the LED modules which is downstream of the one LED module.

4. The device for driving a light-emitting diode according to claim 3, wherein the first and second transistors are each provided with a first terminal, a second terminal and a control terminal, and wherein the first input terminal is connected to the first terminal of the first transistor, and the control terminal of the first transistor is connected to an end of the first resistor, and the other end of the first resistor and the first terminal of the second transistor are connected via a common line to the second output terminal, and wherein the control terminal of the second transistor is connected to an end of the second resistor, while the other end of the second resistor and the second terminal of the first transistor are connected via a common line to the first output terminal, and wherein the second terminal of the second transistor is coupled to the second output terminal, and wherein the fourth resistor is coupled between the control terminal and the second terminal of the second transistor.

5. The device for driving a light-emitting diode according to claim 4, wherein the first and second transistors are NPN-type bipolar junction transistors (BJT), in which the first terminal, the second terminal and the control terminal are an emitter, a collector and a base, respectively.

6. The device for driving a light-emitting diode according to claim 3, wherein the LEDs mounted in the respective LED modules are gradually increased in amount and then decreased in amount from upstream to downstream.

7. The device for driving a light-emitting diode according to claim 6, wherein the respective current guiding control circuits are mounted on a circuit board and then electrically connected to the respective LED modules.

8. The device for driving a light-emitting diode according to claim 6, wherein the respective current guiding control circuits and the respective LED modules are together packaged in an integrated circuit package.

* * * * *